United States Patent [19]

Lassiter, Sr.

[11] 3,940,071

[45] Feb. 24, 1976

[54] SPRAY NOZZLE FOR DISPERSING SAND SLURRY

[75] Inventor: Marvin Stevens Lassiter, Sr., Lakeland, Fla.

[73] Assignee: American Cyanamid Co., Stamford, Conn.

[22] Filed: Oct. 29, 1973

[21] Appl. No.: 410,841

[52] U.S. Cl. ..... 239/524; 239/515

[51] Int. Cl.[2] ..... B05B 1/26

[58] Field of Search ..... 239/514, 515, 518, 524, 239/523

[56] References Cited

UNITED STATES PATENTS

| | | | |
|---|---|---|---|
| 481,082 | 8/1892 | Umholtz | 239/515 X |
| 1,888,690 | 11/1932 | Parel | 239/515 X |
| 2,451,071 | 10/1948 | Cline | 239/515 |
| 2,530,002 | 11/1950 | Coy | 239/515 |
| 3,527,412 | 9/1970 | West | 239/524 |

*Primary Examiner*—John J. Love
*Attorney, Agent, or Firm*—H. G. Jackson

[57] ABSTRACT

A spray nozzle unit including a deflector cone for dispersing sand slurry over a broad area of impounded clay slurry.

2 Claims, 4 Drawing Figures

SPRAY NOZZLE FOR DISPERSING SAND SLURRY

BACKGROUND OF THE INVENTION

1. Field of the Invention

The invention pertains to reclaiming surface mined lands by use of waste products from mining operations.

2. Description of the Prior Art

Since valuable ore deposits often occur in nature intimately mixed with a variety of less valuable or desirable constituents, it is a primary function of the ore processing industry to remove or separate as much of the extraneous constituents from the desired ore as possible. The flotation process developed in the early 1930's has proven to be a valuable tool for assisting in the removal of unwanted waste products from ores and is in wide use today in a variety of ore processing operations. However, since the development and utilization of the flotation process by the ore processing industry, disposal of the waste products resulting therefrom has presented a monumental problem. U.S. Pat. Nos. 3,761,239 (1973) and 3,763,041 (1973) teach processes for removing water from slimes and tailings to yield useful land-fill compositions. U.S. Pat. No. 3,680,698 (1972) suggests the addition of sand to flocculated waste product solids to obtain a high density solid. I have discovered that flocculation is not necessary when sand is added to waste products by spraying a sand slurry over the surface of the waste products using the spray nozzle unit of my invention.

SUMMARY OF THE INVENTION

A spray nozzle unit cmprising a nozzle mounted in the vertical stem of a pipe line tee for dispersing a sand slurry upward, a cone deflector with the configuration of a Tractrix curve mounted with brackets above the nozzle on vertical arms which connects at its lower end to the pipe tee and pressure means for propelling the sand slurry through the nozzle and against and away from the cone to cause a circular spray of the sand slurry.

THE DRAWINGS

FIG. 1 illustrates deflector cone 1 and nozzle 2 mounted in pipe tee 4.

DESCRIPTION INCLUDING THE PREFERRED EMBODIMENTS

Figure 2:
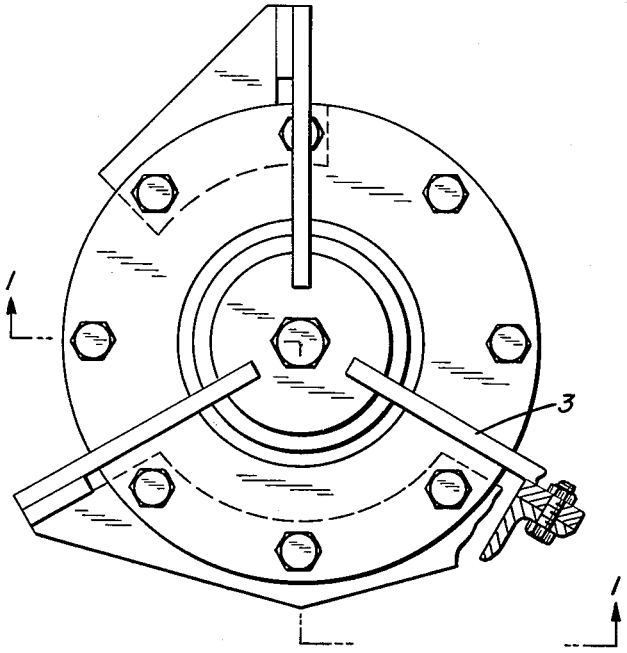
FIG. 2 is a plan view of the deflector cone.
Figure 1:
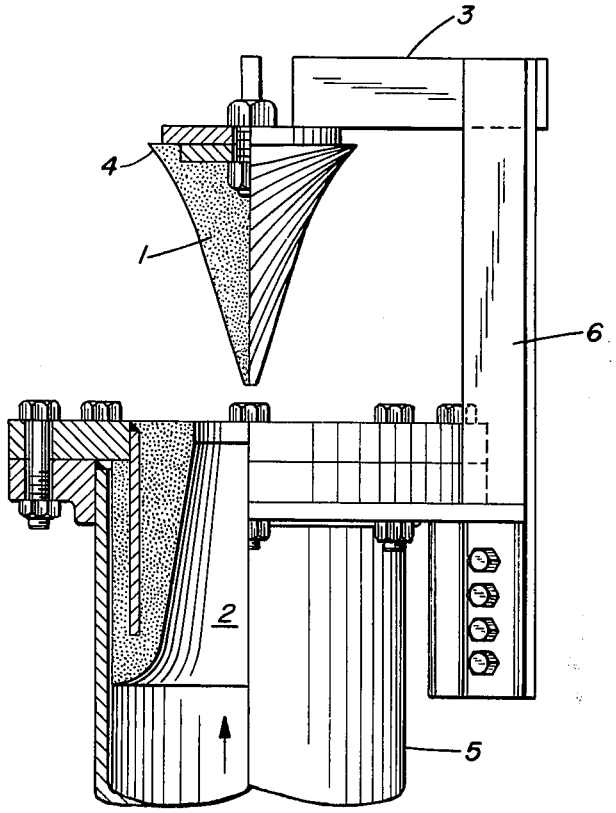

The spray nozzle unit comprises a nozzle 2 FIG. 1 mounted on a pipe tee 4 FIG. 1 for dispersing a sand slurry upward through 2 FIG. 1 against a cone deflector 1 FIG. 1 which is mounted with brackets 3 FIGS. 1 and 2 on the pipe tee 4 FIG. 1 above the nozzle, the cone deflector having a configuration of a Tractrix curve and pressure means for propelling the sand slurry through the nozzle and against and away from the cone to cause a circular spray of sand slurry.

Figure 3:
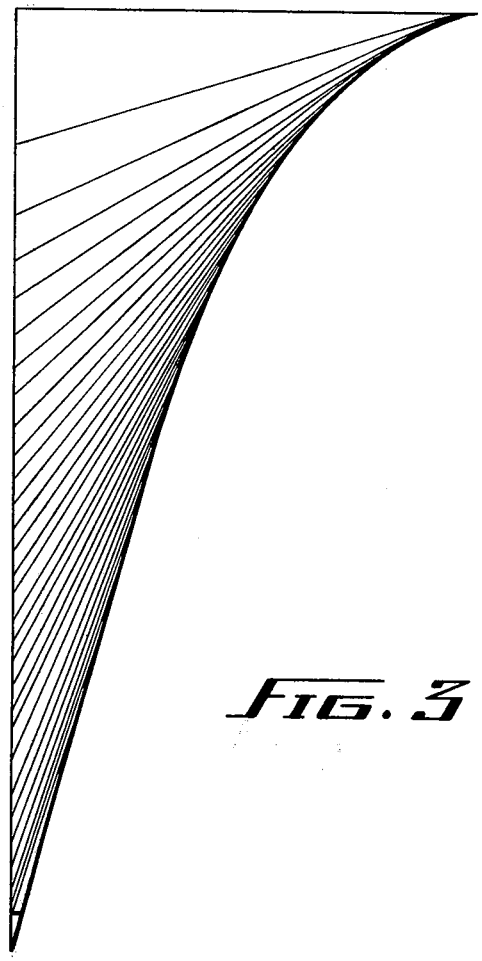
FIG. 3 is a full size Tractrix cone pattern.
Figure 4:
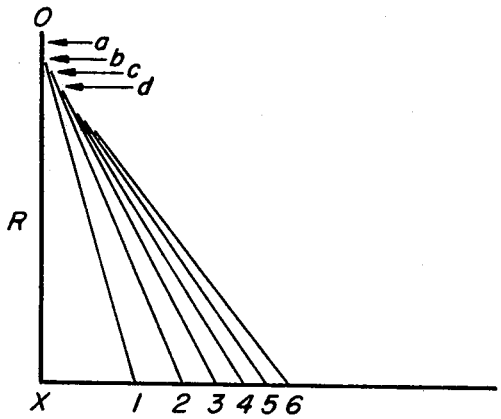
FIG. 4 is a graph describing the deflector cone.

The key component of the unit is the deflector cone 1 FIGS. 1 and 2 machined in the configuration of a Tractrix curve, FIG. 3. The curve is defined in the graph of FIG. 4 as follows: R is the radius of the top of the cone; X, 1, 2, 3, etc. the axis. From O set off on R a small distance, O*a;* with radius R and center *a*, cut the axis at 1, join *a*1, and set off a like small distance *ab;* from *b* with radius R cut axis at 2, join *b*2, etc., finding points O, *a*, *b*, *c*, *d*, etc. through which the curve is to be drawn.

Solids suspended in water such as slimes, tailings, waste, pulps and the like are compacted to a useful state by spraying a sand slurry over the surface of the suspension in such a manner as to give high solids density. The sand slurry is sprayed from a spray nozzle unit, including a deflector cone 1 and spray nozzle 2 of FIGS. 1 and 3 designed to provide maximum uniform area coverage with minimum height of spray. The configuration of the deflector cone 1 is that of a Tractrix or Schiele's anti-friction curve illustrated in FIG. 3. The invention provides a spray cover of a large diameter circle at low hydraulic pressure with minimum spray height to avoid pattern disturbance by the wind.

A sand slurry is pumped with sufficient hydraulic pressure through nozzle 2 of FIG. 1 against the deflector cone 1 of FIG. 1 to give a circular slurry spray of about 90 ft. diameter in the air over the surface of ore processing operations waste products. Nozzle 2 is mounted on a pipe tee 4.

A typical nozzle 2 and cone 1 unit as shown in FIG. 1 is about 18 inches in height. The nozzle 2, about 6 inches in height and about 3 inches in diameter in the upper narrower opening expands downward to a bottom diameter of about 5 inches. The bottom of the deflector cone 1 is centered about 2 inches above the top of the nozzle 2. The bottom of the deflector cone is about ¼ inch in diameter and expands to about 6 inches in diameter where the sand slurry leaves the unit in spray. The deflector cone is held in place by bolting to rackets 3 which are connected to the pipe tee 4 by vertical arms 5.

Maintaining a hydraulic pressure of about 22 psig on the slurry causes a circular spray over the surface of the area having about a 90' diameter.

A sand slurry sprayed over a waste product area affords release of water normally trapped by colloidal clays. Thus, useful soil is formed. Useful, for example, for reclamation of mining pits. In addition, my invention provides rapid recovery of water from the waste products for reuse.

Common practice in phosphate mining operations is to store wastes from the phosphate recovery plants in impoundment areas enclosed by large earth dams. The waste slurries thicken very slowly, so that years may elapse before the expense and hazard of earth dam maintenance can end. Other disadvantages are the initial high cost of large earth dams and the limited use that can be made of old abandoned settling areas.

A mined-out pit was utilized as a test site to illustrate the invention. The test site had a volume capacity of 377.3 acre feet and was equivalent to 21 acres of mine average pit which would produce 118,490 tons of waste clays and 234,016 tons of tailing sand.

Waste clay slurry was metered into the test pit by continuously recording a weir overflow depth and by taking a continuous proportional sample. Liquid level was maintained at or below average natural ground elevation. 122,439 Tons of waste clay were placed in the test pit over a 6 months period. The average concentration of clays in the slurry flowing to the pit was 3.54% solids.

Tailings sand was sprayed over the surface of the test area. Application of the tailings was by pumping the sand slurry through 7 nozzles 2 FIG. 1 mounted on top of two pipelines. The pipelines were mounted on pontoons, so that they could be relocated by towing with a work boat. Spray lines were positioned to distribute sand slurry over approximately 37,000 square feet at each anchored location. Complete coverage of the waste clay slurry surface with tailings sprays is not essential, as there is a considerable drift of sand below the surface of the slimes. The first application of tailings was by two spray periods of 5½ hours each at the same pipeline location. Between these spray periods, tailings were pumped to a location outside of the test area. Seventeen spray pipeline locations were required to cover the test pit area. After the first application, the pit contained 110,867 tons of waste clays and 149,317 tons of tailing sand. The tailings spray pipelines were repositioned to again cover the entire test area with tailings sand. These applications were for 6¼ hours at each location. A total of 236,465 tons of sand was applied to the test area during the entire experiment.

During the spraying, the waste slurry was thickened and clear water was released which could have been recycled immediately. At completion of tailings and spraying, the slurry in the test pit contained 48.6% solids by weight. One and one-half weeks after the final addition of wastes to the test area, piles of earth left piled at the pit edge were pushed into the pit by bulldozers. It was evident that some displacement of slurry occured, but that substantial quantities were enveloped or covered over by the bulldozed material. Three and one-half weeks later a causeway was pushed across both pits of the test area, a distance of approximately 650 feet. Test holes bored through the causeway fill showed that the top 8 to 12 feet or fill material displaced the sand-slime mixture, the next lower two to four feet was mixed fill and sand-slime wastes and below this level was 8 to 14 feet of sand-slime waste material.

I claim:

1. A spray nozzle unit comprising:

a nozzle mounted in a pipe tee for dispersing a sand slurry upward a cone deflector with a configuration of a Tractrix curve mounted with brackets above the nozzle on a vertical arm which connects at its lower end to the pipe tee and pressure means for propelling the sand slurry through the nozzle and against and away from the cone to cause a circular spray of the sand slurry.

2. A spray nozzle according to claim 1 wherein the pressure means is hydraulic pressure.

* * * * *